US008277189B2

(12) United States Patent
DeMania et al.

(10) Patent No.: US 8,277,189 B2
(45) Date of Patent: Oct. 2, 2012

(54) TURBINE BLADE AND ROTOR

(75) Inventors: Alan Richard DeMania, Niskayuna, NY (US); F. Timothy Wendell, Fonda, NY (US); Gary J. Yetto, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 453 days.

(21) Appl. No.: 12/617,683

(22) Filed: Nov. 12, 2009

(65) Prior Publication Data

US 2011/0110784 A1 May 12, 2011

(51) Int. Cl.
*F01D 5/14* (2006.01)

(52) U.S. Cl. ..... 416/193 A; 416/236 R

(58) Field of Classification Search ..... 416/219 R, 416/193 A, 191, 248, 236 R; 415/169.3
See application file for complete search history.

(56) References Cited

U.S. PATENT DOCUMENTS 3,304,056 A * 2/1967 Sohma ..... 415/169.4
4,155,152 A * 5/1979 Cretella et al. ..... 29/889.1
4,714,410 A * 12/1987 Hancock ..... 416/193 A
5,267,834 A 12/1993 Dinh et al.
5,277,549 A 1/1994 Chen et al.
5,480,285 A 1/1996 Patel et al.
6,030,178 A * 2/2000 Caruso ..... 416/220 R
6,575,700 B2 6/2003 Arai et al.
7,318,699 B2 * 1/2008 Serafini et al. ..... 415/169.4

FOREIGN PATENT DOCUMENTS

JP 55078103 A * 6/1980

* cited by examiner

*Primary Examiner* — Richard Edgar
(74) *Attorney, Agent, or Firm* — Hoffman Warnick LLC; Ernest G. Cusick

(57) ABSTRACT

Embodiments of the invention relate generally to turbine blades and rotors and, more particularly, to turbine blades having, among other features, complimentarily shaped integral covers and bases capable of increasing stiffness and damping characteristics while decreasing vibratory stress. In one embodiment, the invention provides a turbine blade comprising: an elongate vane having a twisted configuration about a longitudinal axis thereof, the elongate vane having a leading face and a trailing face; a base at a proximal end of the elongate vane, the base having: a substantially planar member substantially normal to the longitudinal axis of the elongate vane; and a dovetail member on a surface of the planar member opposite the elongate vane; and a cover member at a distal end of the elongate vane, the cover member having a leading face and a trailing face.

20 Claims, 5 Drawing Sheets

TURBINE BLADE AND ROTOR

BACKGROUND OF THE INVENTION

Embodiments of the invention relate generally to turbine blades and rotors and, more particularly, to turbine blades having, among other features, complimentarily shaped integral covers and bases capable of increasing stiffness and damping characteristics while decreasing vibratory stress.

Turbine blades, particularly those operating at high speeds and/or experiencing high loads, are subject to stresses, including vibratory stress, that can reduce the overall efficiency of the turbine, shorten the life of the turbine blades or other rotor components, and, in some cases, lead to failure of the turbine blade itself and/or other rotor components. As such, turbine blades exhibiting improved stiffness or damping characteristics, or subject to decreased vibratory stress, are generally capable of operating at higher speeds and/or bearing higher loads, and exhibit improved efficiency and increased life.

BRIEF DESCRIPTION OF THE INVENTION

In one embodiment, the invention provides a turbine blade comprising: an elongate vane having a twisted configuration about a longitudinal axis, the elongate vane having a leading face and a trailing face; a base at a proximal end of the elongate vane, the base having: a substantially planar member substantially normal to the longitudinal axis of the elongate vane; a protrusion at a trailing face of the planar member, the protrusion supporting a portion of the proximal end of the elongate vane; a relief at a leading face of the planar member, a shape of the relief being substantially complimentary to a shape of the protrusion; and a dovetail member on a surface of the planar member opposite the elongate vane; and a cover member at a distal end of the elongate vane, the cover member being substantially normal to the longitudinal axis of the elongate vane and having a leading face and a trailing face, the shapes of the leading and trailing faces being substantially complimentary.

Another embodiment of the invention provides a turbine blade comprising: an elongate vane having a twisted configuration about a longitudinal axis thereof, the elongate vane having a leading face and a trailing face; a base at a proximal end of the elongate vane, the base having: a substantially planar member substantially normal to the longitudinal axis of the elongate vane; and a dovetail member on a surface of the planar member opposite the elongate vane; and a cover member at a distal end of the elongate vane, the cover member having a leading face and a trailing face.

Still another embodiment of the invention provides a rotor comprising: a rotor wheel having a plurality of axially-oriented dovetail openings; a plurality of turbine blades, each turbine blade having: an elongate vane having a twisted configuration about a longitudinal axis thereof; a base at a proximal end of the elongate vane, the base having: a substantially planar member substantially normal to the longitudinal axis of the elongate vane; and a dovetail member on a surface of the planar member opposite the elongate vane, a shape of the dovetail member being complimentary to a shape of the at least one of the plurality of axially-oriented dovetail openings; and a cover member at a distal end of the elongate vane, the cover member being substantially normal to the longitudinal axis of the elongate vane and having a leading face and a trailing face, the shapes of the leading and trailing faces being substantially complimentary.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
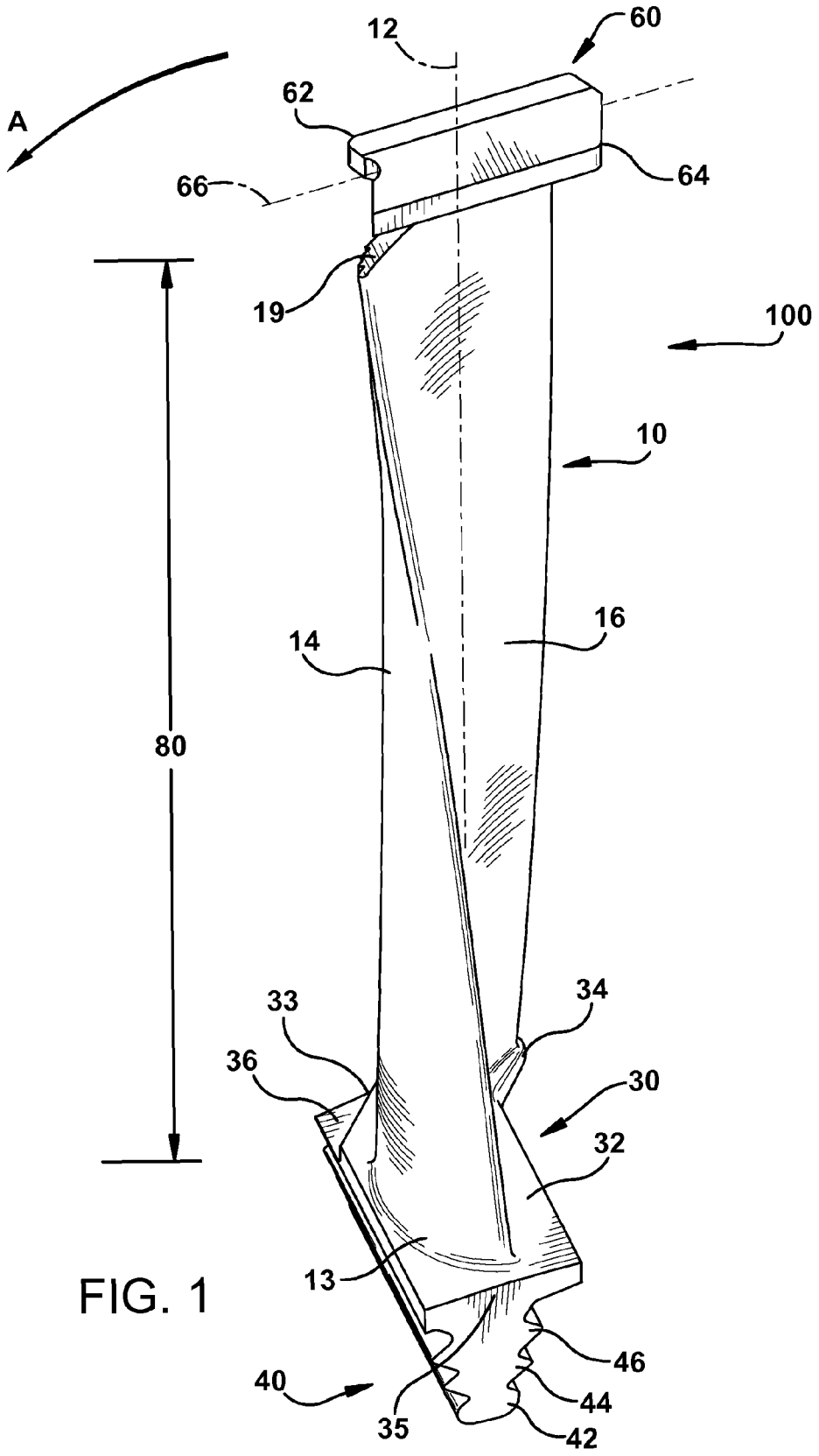
FIG. 1 shows a perspective view of a turbine blade according to an embodiment of the invention.

FIG. 1 shows a perspective view of a turbine blade 100 according to an embodiment of the invention. Turbine blade 100 includes an elongate vane 10 having a twisted configuration about its longitudinal axis 12, a base 30 at the proximal end 13 of elongate vane 10, a dovetail member 40 for mating turbine blade 100 with a rotor wheel (not shown), and an integrated cover 60 at the distal end 19 of vane 10. As used herein, the term "twisted," when used in describing a configuration of elongate vane 10, is meant to refer to an unequal bending, turning, or wrapping of elongate vane 10 along its radial height 80. That is, as shown in FIG. 1, distal end 19 of elongate vane 10 is turned or wrapped about longitudinal axis 12 to a greater degree than is proximal end 13.

A substantially planar member 32 is oriented substantially normal to longitudinal axis 12 of elongate vane 10. That is, while a surface of planar member 32 may include a slightly arcuate shape in order to accommodate its insertion into a rotor wheel (described in greater detail below), the surface at which it meets elongate vane 10 is substantially planar, such that longitudinal axis 12 of elongate vane 10 forms an angle of about 90 degrees with planar member 32. Cover 60 is oriented such that its longitudinal axis 66 is substantially perpendicular to longitudinal axis 12 of elongate vane 10.

In operation, turbine blade 100 travels in direction A. As such, vane 10 includes a leading face 14 and a trailing face 16. Base 30 includes substantially planar member 32 having a leading face 35 and a trailing face 33, and cover 60 includes a leading face 62 and a trailing face 64. In some embodiments, leading face 14 of elongate vane 10 is flame-hardened.

Planar member 32 includes a relief 36 or fillet along its leading face 35 and a complimentarily-shaped protrusion 34 along its trailing face 33, such that (as will be described in greater detail below) adjacent turbine blades 100 form a tied-in edge. Beneath planar member 32, as noted above, dovetail member 40 facilitates mating blade 100 with a rotor wheel. Hooks 42, 44, 46 have shapes complimentary to axially-oriented dovetail openings in the rotor wheel. In operation, hooks 42, 44, 46 serve to transmit the rotor load from blade 100 to the rotor wheel in a known fashion.

While dovetail member 40 is shown in FIG. 1 as having three hooks 42, 44, 46, this is not essential. Any number of hooks may be employed. Similarly, while hooks 42, 44, 46 are shown having similar shapes of different sizes, this also is not essential. That is, hooks 42, 44, 46 may have different shapes and/or be of similar sizes. In such cases, axially-oriented dovetail openings in the rotor wheel are of complimentary shapes and sizes.

Figure 2:
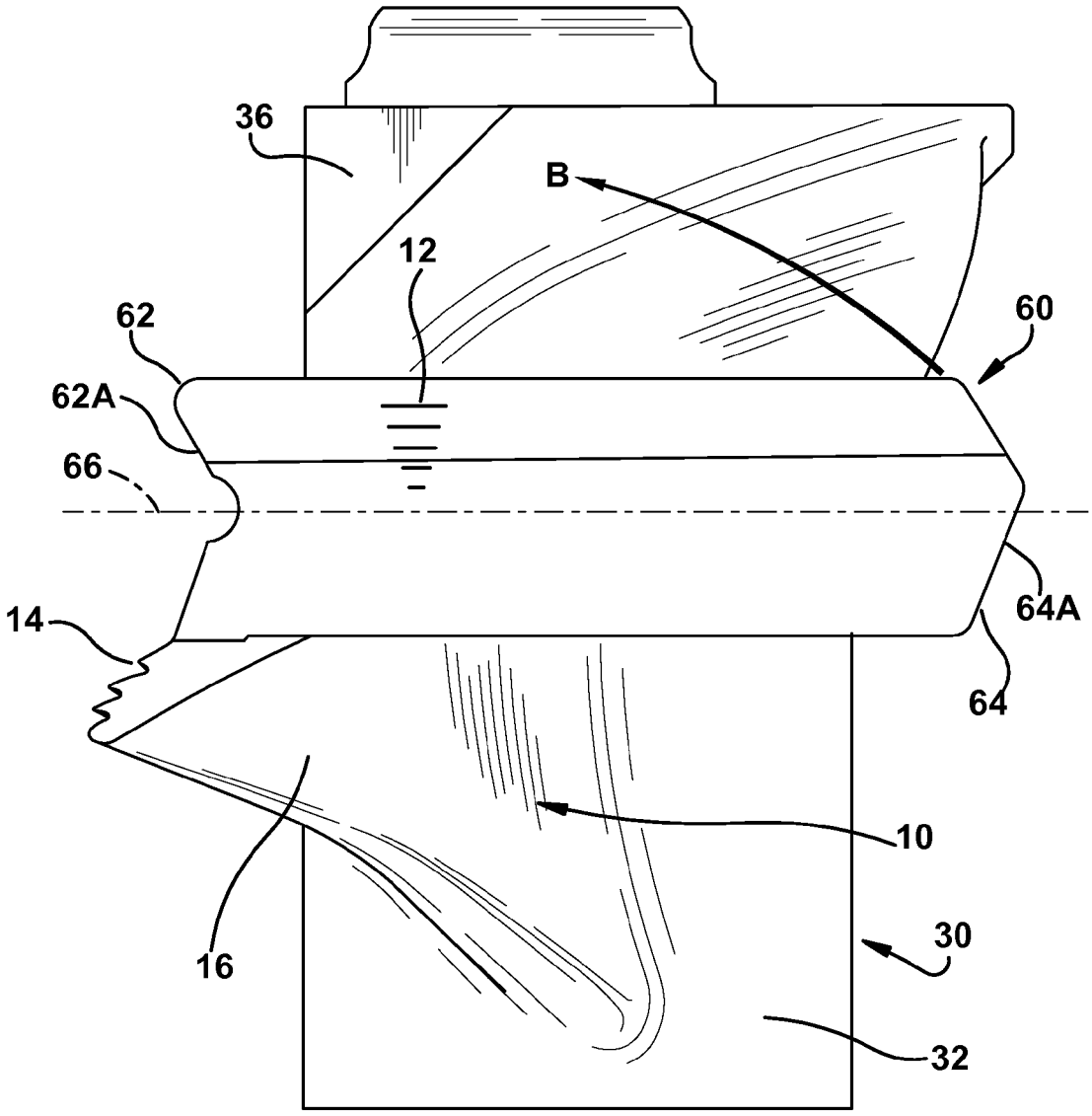
FIG. 2 shows a top-down view of the turbine blade of FIG. 1.

FIG. 2 shows a top-down view of turbine blade 100. Leading face 62 of cover 60 is shown having a notch 62A, the shape of which is substantially complimentary to a point 64A of trailing face 64. Thus, a pair of blades 100, when installed in adjacent positions in a rotor wheel, exhibit an interference fit (described in greater detail below) between a trailing face 64 of one blade and a leading face 62 of the adjacent blade. As vane 10 "untwists" in response to increasing load, cover 60 of each blade 100 turns in direction B, increasing the interference.

Figure 3:
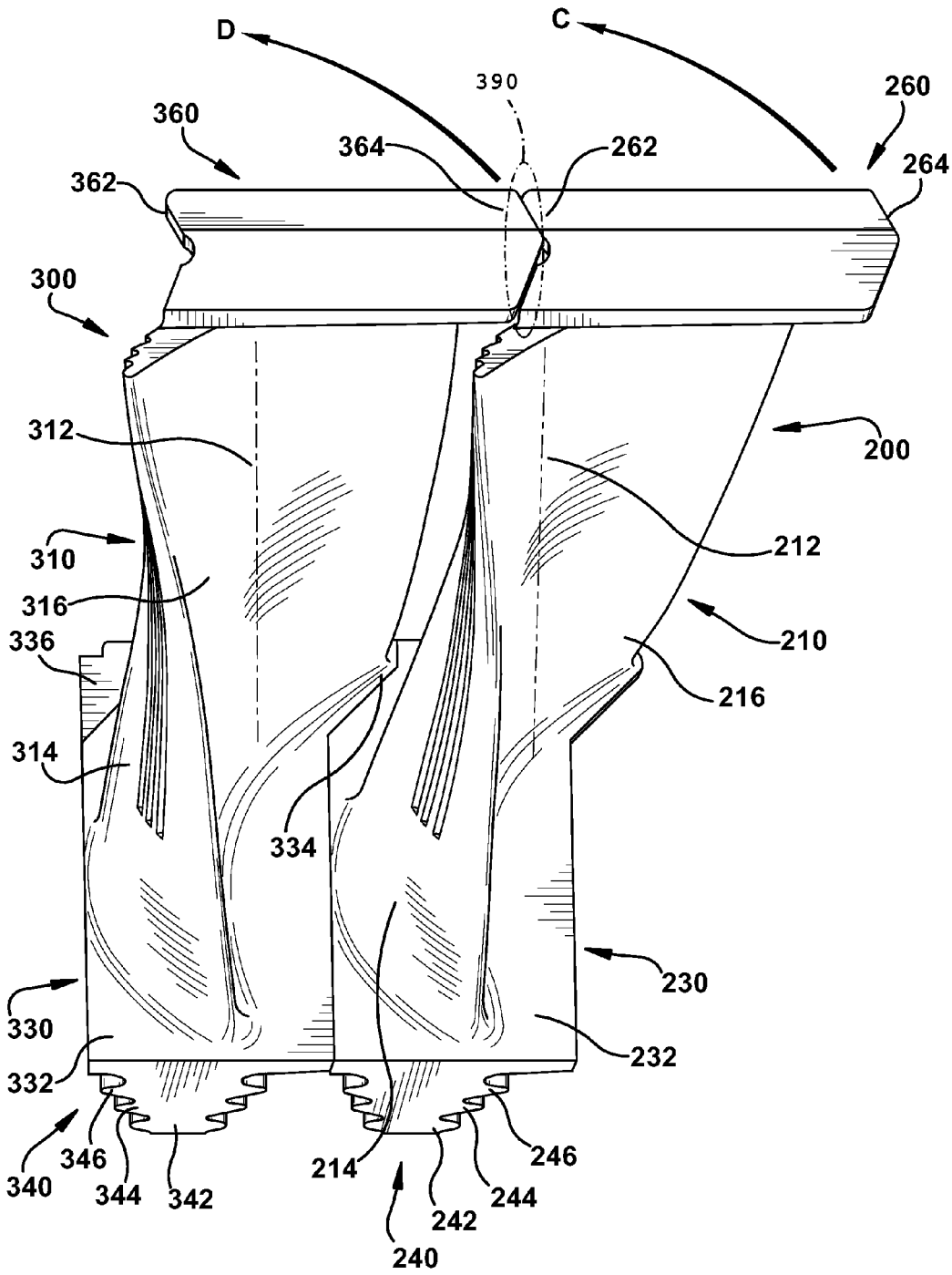
FIG. 3 shows a side elevational view of two turbine blades according to embodiments of the invention, positioned substantially as they would be when installed in a rotor wheel.

FIG. 3 shows a side elevational view two turbine blades 200, 300, positioned substantially as they would be when installed in adjacent positions of a rotor wheel (not shown). When so positioned, protrusion 334 of turbine blade 300 covers the relief (obscured) of turbine blade 200. Similarly, the protrusion of an additional turbine blade, if installed adjacent turbine blade 300 (i.e., on a side of turbine blade 300 opposite turbine blade 200), would cover relief 336 of turbine blade 300.

As can be seen in FIG. 3, leading face 262 of turbine blade 200 forms an interference fit 390 with trailing face 364 of turbine blade 300. In an assembled rotor (i.e., where all available axially-oriented dovetail openings in a rotor wheel are filled with such turbine blades), this interference fit provides a continuous coupling of the blades, resulting in superior stiffness, superior damping characteristics, and low vibratory stress, when compared to "free-standing" designs lacking such interference.

In operation, as the load on turbine blades 200, 300 increases, vanes 210, 310 will deform, i.e., they will "untwist" about their longitudinal axes 212, 312, respectively. As a result, cover 260 of turbine blade 200 will move in direction C (i.e., about longitudinal axis 212 in a direction opposite the twisting of vane 210) and cover 360 of turbine blade 300 will move in direction D (i.e., about longitudinal axis 312 in a direction opposite the twisting of vane 310), thereby increasing interference fit 390, resulting in increased stiffness and damping and decreasing vibratory stress in the assembled rotor.

Figure 4:
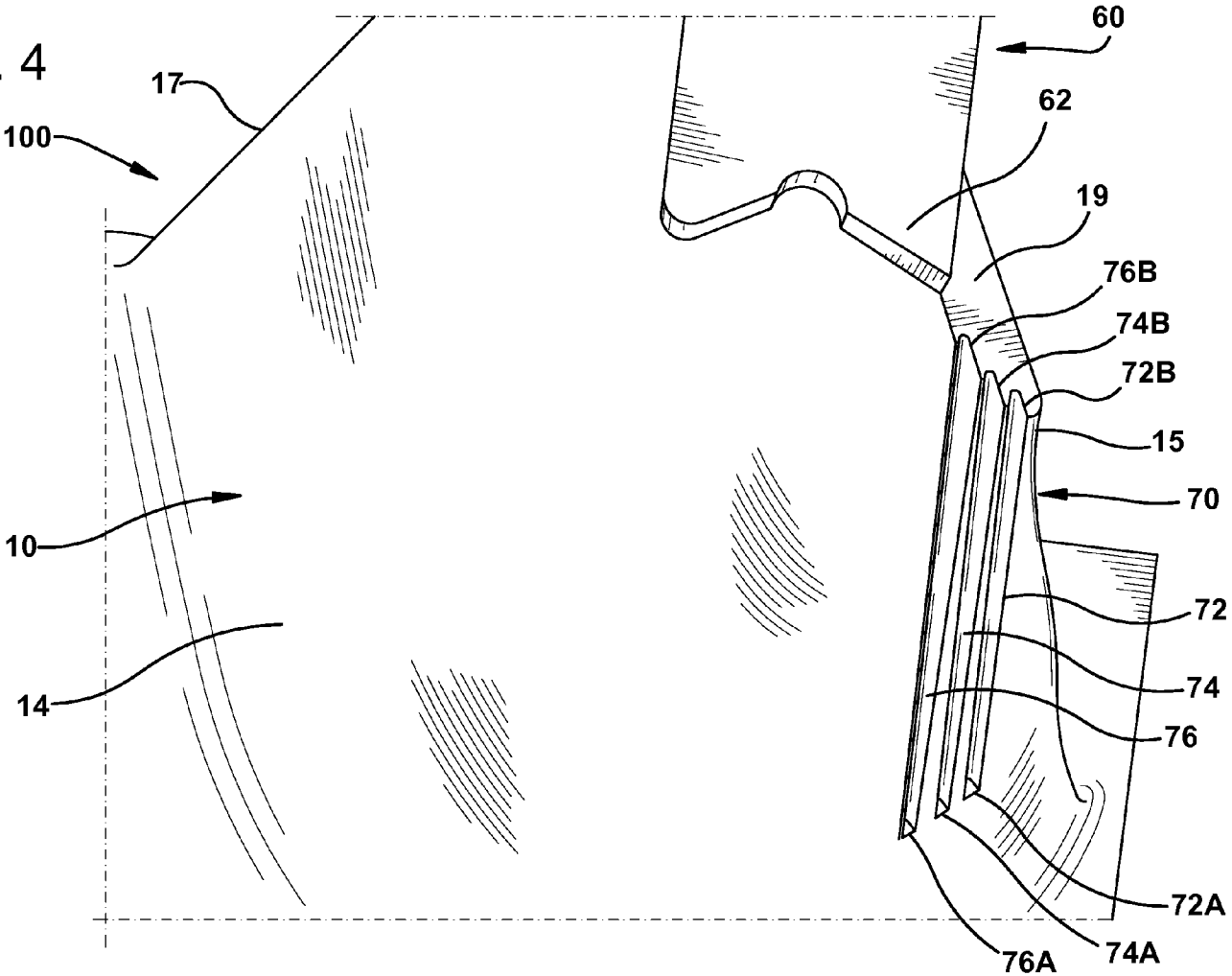
FIG. 4 shows a partial side elevational view of the turbine blade of FIG. 1.

Referring now to FIG. 4, a partial side elevational view of turbine blade 100 of FIG. 1 is shown. As can be seen, a plurality 70 of longitudinal grooves 72, 74, 76 is disposed along leading face 14 of vane 10. Longitudinal grooves 72, 74, 76 act to remove moisture which may form on leading face 14 during operation. Each longitudinal groove 72, 74, 76 includes a first end 72A, 74A, 76A positioned between about one-third and about one-half the radial height 80 (FIG. 1) of vane 10, as measured from the distal end 19 of vane 30, and a second end 72B, 74B, 76B at distal end 19 of vane 30. As such, longitudinal grooves 72, 74, 76 cover between about one-third and about one-half the radial height 80 of vane 10. In some embodiments, longitudinal grooves 72, 74, 76 cover about 40% of radial height 80 of vane 10. As noted above, leading face 14 may be flame-hardened. Similarly, longitudinal grooves 72, 74, 76 may be flame-hardened, which acts to prevent erosion as moisture is removed from leading face 14.

In some embodiments of the invention, the plurality 70 of longitudinal grooves 72, 74, 76 is disposed nearer the leading edge 15 than the trailing edge 17 of vane 10. As such, second ends 72B, 74B, 76B of longitudinal grooves 72, 74, 76 are preferably not obscured by cover 60, which would impede the removal of moisture from leading face 14.

Figure 5:
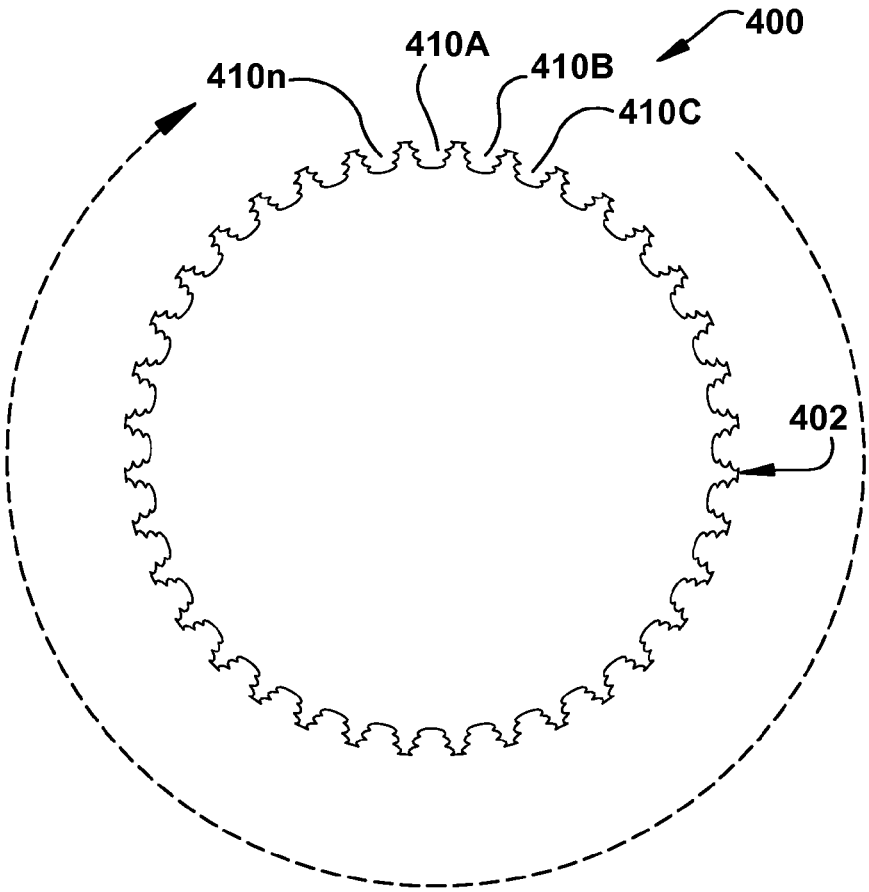
FIGS. 5 and 6 show full and partial cross-sectional views, respectively, of a rotor wheel into which turbine blades according to embodiments of the invention may be installed.
Figure 6:
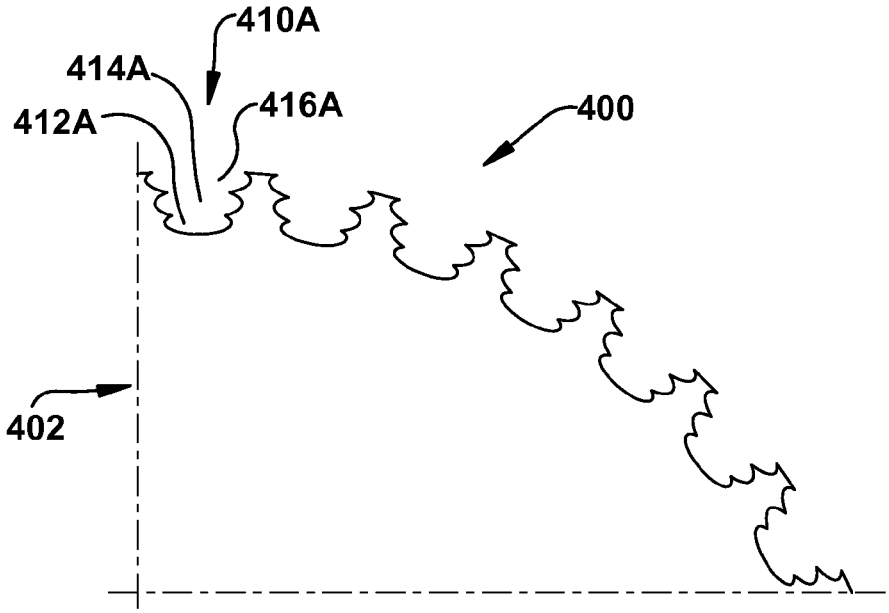

FIGS. 5 and 6 show full and partial side cross-sectional views, respectively, of a rotor wheel 400 according to an embodiment of the invention. Referring to FIG. 5, rotor wheel 400 includes a circular rotor body 402 and a plurality of axially-oriented dovetail openings 410A, 410B, 410C . . . 410*n* positioned about its circumference. Each of the axially-oriented dovetail openings 410A, 410B, 410C . . . 410*n* has a shape complimentary to dovetail member 40 (FIG. 1) of turbine blade 100, permitting axial insertion of turbine blade 100 into, for example, axially-oriented dovetail opening 410A.

FIG. 6 shows a more detailed view of a portion of rotor wheel 400. Axially-oriented dovetail opening 410A, it can be seen, includes a plurality of slots 412A, 414A, 416A having shapes complimentary to hooks 42, 44, 46 of dovetail member 40 of turbine blade 100 (FIG. 1). It should be noted that the number of axially-oriented dovetail openings 410A, 410B, 410C . . . 410*n* shown is merely illustrative. A rotor wheel according to the invention may include any number of such axially-oriented dovetail openings. Similarly, while each of the axially-oriented dovetail openings 410A, 410B, 410C . . . 410*n* shown in FIGS. 5 and 6 are of substantially the same cross-sectional shape, this is not essential. That is, axially-oriented dovetail openings may have different shapes, as long as each is complimentary to a corresponding dovetail member of a turbine blade, such that the turbine blade may be fully installed into the rotor wheel.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbine blade comprising:

an elongate vane having a twisted configuration about a longitudinal axis, the elongate vane having a leading face and a trailing face;

a base at a proximal end of the elongate vane, the base having:

a substantially planar member substantially normal to the longitudinal axis of the elongate vane;

a protrusion at a trailing face of the planar member, the protrusion supporting a portion of the proximal end of the elongate vane extending beyond the planar member due to the twisted configuration;

a relief at a leading face of the planar member, a shape of the relief being substantially complimentary to a shape of the protrusion; and a dovetail member on a surface of the planar member opposite the elongate vane, the dovetail member set nearer a leading face than the trailing face of the planar member; and a cover member at a distal end of the elongate vane, the cover member being substantially normal to the longitudinal axis of the elongate vane and having a leading face and a trailing face, the shapes of the leading and trailing faces being substantially complimentary.

2. The turbine blade of claim 1, wherein a longitudinal axis of the cover member is substantially perpendicular to a longitudinal axis of the planar member.

3. The turbine blade of claim 1, wherein the shape of the leading face of the cover member includes a notch and the shape of the trailing face of the cover member includes a point substantially complimentary to the notch.

4. The turbine blade of claim 1, wherein the cover member is moveable in a direction opposite a direction in which the elongate vane is twisted about its longitudinal axis in response to an untwisting of the elongate vane.

5. The turbine blade of claim 1, wherein the elongate vane further comprises at least one elongate groove along a length of its leading face.

6. The turbine blade of claim 5, wherein the at least one elongate groove includes:

a first end at between about one-third and about one-half a radial height of the elongate vane; and a second end at the distal end of the elongate vane.

7. The turbine blade of claim 6, wherein the cover member is adjacent to but does not cover the second end of the at least one elongate groove.

8. The turbine blade of claim 5, wherein the at least one elongate groove is flame-hardened.

9. The turbine blade of claim 1, wherein the leading face of the elongate vane is flame-hardened.

10. The turbine blade of claim 1, wherein the dovetail member includes a plurality of hooks.

11. The turbine blade of claim 10, wherein the plurality of hooks are similarly-shaped and differently-sized.

12. A turbine blade comprising:

an elongate vane having a twisted configuration about a longitudinal axis thereof, the elongate vane having a leading face and a trailing face;

a base at a proximal end of the elongate vane, the base having:

a substantially planar member substantially normal to the longitudinal axis of the elongate vane;

a protrusion at a trailing face of the planar member, the protrusion supporting a portion of the proximal end of the elongate vane extending beyond the planar member due to the twisted configuration; and a dovetail member on a surface of the planar member opposite the elongate vane, the dovetail member set nearer a leading face than the trailing face of the planar member; and a cover member at a distal end of the elongate vane, the cover member having a leading face and a trailing face.

13. The turbine blade of claim 12, wherein the elongate vane further comprises at least one elongate groove along a length of a leading face thereof.

14. A rotor comprising:

a rotor wheel having a plurality of axially-oriented dovetail openings;

a plurality of turbine blades, each turbine blade having:

an elongate vane having a twisted configuration about a longitudinal axis thereof;

a base at a proximal end of the elongate vane, the base having:

a substantially planar member substantially normal to the longitudinal axis of the elongate vane;

a protrusion at a trailing face of the planar member, the protrusion supporting a portion of the proximal end of the elongate vane extending beyond the planar member due to the twisted configuration; and a dovetail member on a surface of the planar member opposite the elongate vane, a shape of the dovetail member being complimentary to a shape of the at least one of the plurality of axially-oriented dovetail openings, the dovetail member set nearer a leading face than the trailing face of the planar member; and a cover member at a distal end of the elongate vane, the cover member being substantially normal to the longitudinal axis of the elongate vane and having a leading face and a trailing face, the shapes of the leading and trailing faces being substantially complimentary.

15. The rotor of claim 14, wherein the planar member includes a protrusion at a trailing face and a relief at a leading face, the shapes of the protrusion and relief being substantially complimentary.

16. The rotor of claim 14, wherein the elongate vane includes a leading face and a trailing face and the leading face includes at least one elongate groove along a length thereof.

17. The rotor of claim 16, wherein the at least one elongate groove includes:

a first end at between about one-third and about one-half a radial height of the elongate vane; and a second end at the distal end of the elongate vane.

18. The rotor of claim 16, wherein the leading face of the elongate vane and the at least one elongate groove are flame-hardened.

19. The rotor of claim 14, wherein the dovetail member includes a plurality of hooks.

20. The rotor of claim 19, wherein the plurality of hooks are similarly-shaped and differently-sized.

* * * * *